US008465257B1

(12) United States Patent
Noble et al.

(10) Patent No.: US 8,465,257 B1
(45) Date of Patent: Jun. 18, 2013

(54) VARIABLE PITCH PROPELLER

(75) Inventors: Mark C. Noble, Pleasant Prairie, WI (US); Richard McChesney, Waukegan, IL (US); Laverne Tatge, Kenosha, WI (US); Dave Calamia, Burlington, WI (US); Gerald Ewens, Pleasant Prairie, WI (US); Rudolf Wendler, Grayslake, IL (US); Simon Pfiffner, Deerfield, IL (US)

(73) Assignee: BRP US Inc., Sturtevant, WI (US)

( * ) Notice: Subject to any disclaimer, the term of this patent is extended or adjusted under 35 U.S.C. 154(b) by 883 days.

(21) Appl. No.: 12/609,511

(22) Filed: Oct. 30, 2009

Related U.S. Application Data

(60) Provisional application No. 61/110,094, filed on Oct. 31, 2008.

(51) Int. Cl.
*B63H 3/04* (2006.01)

(52) U.S. Cl.
USPC ..... 416/167; 440/60

(58) Field of Classification Search
USPC ..... 416/1, 147, 164, 166, 167, 153, 154, 416/108, 109, 110, 112, 113, 114, 115, 116; 440/50
See application file for complete search history.

(56) References Cited

U.S. PATENT DOCUMENTS

| | | | | |
|---|---|---|---|---|
| 657,844 | A * | 9/1900 | Williams et al. | 416/167 |
| 2,352,186 | A | 6/1944 | Corrigan | |
| 2,357,229 | A | 8/1944 | Werner | |
| 2,969,118 | A * | 1/1961 | Allen, Jr. | 416/154 |
| 2,971,585 | A * | 2/1961 | Barrasso et al. | 416/157 R |
| 3,170,521 | A * | 2/1965 | Gaubis et al. | 416/48 |
| 3,295,610 | A | 1/1967 | Frias | |
| 3,501,251 | A | 3/1970 | Haglund et al. | |
| 3,560,108 | A | 2/1971 | Lindahl | |
| 3,589,830 | A | 6/1971 | Mogren et al. | |
| 3,645,644 | A | 2/1972 | Schwisow | |
| 3,802,800 | A | 4/1974 | Merkx et al. | |
| 3,853,427 | A * | 12/1974 | Holt | 416/167 |
| 4,588,354 | A | 5/1986 | Duchesneau et al. | |
| 5,061,212 | A | 10/1991 | Morgenthaler et al. | |
| 5,368,442 | A * | 11/1994 | Speer | 416/167 |
| 5,415,523 | A | 5/1995 | Muller | |
| 5,464,324 | A * | 11/1995 | Langenberg | 416/167 |
| 5,762,474 | A | 6/1998 | Chatelain | |

(Continued)

FOREIGN PATENT DOCUMENTS

| | | |
|---|---|---|
| EP | 0328966 A1 | 8/1989 |
| EP | 0464085 B1 | 1/1994 |

*Primary Examiner* — Nathaniel Wiehe
*Assistant Examiner* — Ryan Ellis
(74) *Attorney, Agent, or Firm* — BCF LLP

(57) ABSTRACT

A propeller assembly is disclosed, comprising propeller blades pivotably mounted on a propeller hub. A cam follower is disposed on each propeller blade. A cam is movable between a first position, a second position and a third position. Recesses formed in the cam have a first segment, a second segment and a third segment, oriented at first, second and third angles. The first segment is oriented at a first angle relative to the central axis. The cam followers engage the first segment of the recesses when the cam moves between first and second positions to vary the pitch of the propeller blades between a first pitch and a second pitch. The cam followers engage the second segment of the recesses when the cam moves between second and third positions to vary the pitch of the propeller blades between the second pitch and a third pitch.

25 Claims, 14 Drawing Sheets

U.S. PATENT DOCUMENTS 5,836,743 A 11/1998 Carvalho et al.
6,250,979 B1 6/2001 Muller
6,644,922 B2 11/2003 McCallum et al.
6,896,564 B2 5/2005 Willmot

* cited by examiner

VARIABLE PITCH PROPELLER

CROSS-REFERENCE

The present application claims priority to U.S. Provisional Patent Application No. 61/110,094 filed on Oct. 31, 2008, the entirety of which is incorporated herein by reference.

FIELD OF THE INVENTION

The present invention relates to a variable pitch propeller, specifically for marine applications.

BACKGROUND OF THE INVENTION

Many boats and other watercraft are propelled by one or more inboard or outboard engines or a stern drive system, which drives one or more propellers. Each propeller typically has three or four blades, but may have as few as two or as many as five or six. The base of each blade is mounted at an angle, or pitch, relative to a radial plane transverse to the axis of rotation of the propeller shaft. Propellers may be constructed with blades having a fixed pitch. The fixed pitch is typically at an angle that provides maximum efficiency at normal cruising speeds, however fixed pitch propellers typically have reduced efficiency at lower vehicle speeds. Alternatively, the pitch of a propeller can be fixed at an angle that provides better acceleration or pulling capacity at lower speeds, which typically results in a reduced top speed. As a result, fixed pitch propellers typically are a compromise between good acceleration, a higher top speed and fuel consumption.

One way to improve the efficiency of propellers at most speeds is to provide a propeller with blades having a variable pitch. One example of a variable pitch propeller is described in U.S. Pat. No. 6,896,564, which is incorporated herein by reference in its entirety. Variable pitch propellers allow for increased efficiency at both low and high speeds, but they are subject to a number of design concerns. Some variable pitch mechanisms are either manually actuated or self-regulated based on either propeller RPM or torque on the propeller blades that urges the blades to a different pitch position against a biasing force. These mechanisms are prone to being inaccurate and do not allow fine adjustment control over the blade pitch. In addition, these mechanisms generally do not allow sufficient pitch variation for the propeller to propel the watercraft in a reverse direction. In addition, variable pitch propeller assemblies must operate within a limited range of size and weight, particularly if it is also desired to vent engine exhaust through the propeller assembly, imposing limits on the size of the actuator and its freedom of movement, thereby imposing a trade-off between finer pitch control and a wider range of available pitch angles.

One example of a variable pitch propeller that addresses some of these deficiencies is described in U.S. patent application Ser. No. 11/962,372, which is incorporated herein by reference in its entirety. While this variable pitch propeller design is adequate, further improvements are possible to provide a simplified, durable mechanism for varying the pitch of the blades, as well as varying the pitch at a non-constant rate.

In addition, outboard engines may be equipped with a transmission disposed in the gear case, to enable the propeller to selectively reverse the direction of rotation of the propeller to propel the boat in the reverse direction, and to provide a neutral position. This transmission adds size and weight to the gear case, resulting in increased drag and fuel consumption. There is a need for a variable pitch propeller capable of propelling a boat in either the forward or reverse direction and providing a neutral position, and having reduced size and weight.

Therefore, there is a need for a variable pitch propeller having reduced size, weight and complexity.

There is also a need for a variable pitch propeller providing both a wide range of available pitch angles and fine pitch control.

SUMMARY OF THE INVENTION

It is an object of the present invention to ameliorate at least some of the inconveniences present in the prior art.

It is a further object of the present invention to provide a variable pitch propeller having a simple construction.

It is a further object of the present invention to provide a variable pitch propeller capable of varying a pitch angle at different rates.

It is a further object of the invention to provide a variable pitch propeller capable of fine pitch control when the propeller provides thrust in the forward direction, and rapid change of pitch to provide thrust in the reverse direction.

It is a further object of the invention to provide a method of varying the pitch of a propeller blade that provides thrust in the forward direction, and rapid change of pitch to provide thrust in the reverse direction.

In one aspect, the invention provides a marine outboard engine, comprising a cowling. An engine is disposed in the cowling. A driveshaft is disposed generally vertically. The driveshaft has a first end and a second end. The first end of the driveshaft is operatively connected to the engine. A gear case is disposed generally below the engine. A propeller shaft is disposed at least in part in the gear case. The propeller shaft has a propeller shaft axis oriented generally perpendicularly to the driveshaft. The propeller shaft is operatively connected to the second end of the driveshaft. An actuator is disposed within the gear case. The actuator has a cam. The actuator is movable relative to the gear case between a first position, a second position and a third position. The second position is between the first position and the third position. At least one recess is formed in the cam. Each of the at least one recess lies generally in a corresponding plane parallel to the propeller shaft axis. Each of the at least one recess has a first segment, a second segment and a third segment. The second segment is between the first segment and the third segment. The first segment is oriented at a first angle relative to the propeller shaft axis. The second segment is oriented at a second angle relative to the propeller shaft axis. The second angle is greater than the first angle. The third segment is oriented at a third angle relative to the propeller shaft axis. The third angle is smaller than the second angle. A propeller hub is mounted to the propeller shaft. At least one propeller blade is pivotably mounted on the propeller hub. The at least one propeller blade is pivotable with respect to the propeller hub about a corresponding pivot axis. Each pivot axis is oriented generally perpendicularly to the propeller shaft axis. At least one cam follower is disposed on a corresponding one of the at least one propeller blade and is adapted to engage a corresponding one of the at least one recess. The at least one cam follower engages the first segment of its corresponding one of the at least one recess when the actuator moves between the first and second positions to vary a pitch of the at least one propeller blade between a first pitch and a second pitch. The at least one cam follower engages the second segment of its corresponding one of the at least one recess when the actuator moves between the second and third positions to vary the pitch of the at least one propeller blade between the second pitch and a third pitch.

In a further aspect, when the at least one cam follower engages the first segment of its corresponding one of the at least one recess, the pitch of the at least one propeller blade is such that operation of the marine outboard engine propels a watercraft in a forward direction when the propeller shaft is driven in a first direction.

In a further aspect, when the at least one cam follower engages at least a portion of the second segment of its corresponding one of the at least one recess, the pitch of the at least one propeller blade is such that operation of the marine outboard engine propels the watercraft in a reverse direction when the propeller shaft is driven in the first direction.

In a further aspect, the at least one recess includes three recesses. The at least one propeller blade includes three propeller blades. The at least one cam follower includes three cam followers.

In a further aspect, the at least one recess includes four recesses. The at least one propeller blade includes four propeller blades. The at least one cam follower includes four cam followers.

In a further aspect, the first segment of each recess is disposed forwardly of the second segment of their respective recess.

In a further aspect, the actuator is disposed at least in part inside the propeller shaft.

In a further aspect, the pitch of the at least one propeller blade varies between the first pitch and the second pitch at a first rate relative to a rate of movement of the actuator. The pitch of the at least one propeller blade varies between the second pitch and the third pitch at a second rate relative to a rate of movement of the actuator. The second rate is greater than the first rate.

In a further aspect, the second rate is at least 5 times the first rate.

In a further aspect, the first rate is less than 1.0 degrees per 1 mm of movement of the actuator.

In a further aspect, the first rate is approximately 0.3 degrees per 1 mm of movement of the actuator.

In a further aspect, the second rate is greater than 1.0 degrees per 1 mm of movement of the actuator.

In a further aspect, the second rate is approximately 3 degrees per 1 mm of movement of the actuator.

In an additional aspect, the invention provides a propeller assembly, comprising a propeller hub. At least one propeller blade is pivotably mounted on the propeller hub. The at least one propeller blade is pivotable with respect to the propeller hub about a corresponding pivot axis. Each pivot axis is oriented generally perpendicularly to a central axis of the propeller hub. At least one cam follower is disposed on a corresponding one of the at least one propeller blade. A cam is disposed at least in part inside the propeller hub. The cam is movable relative to the propeller hub along the central axis between a first position, a second position and a third position. The second position is between the first position and the third position. At least one recess is formed in the cam. The at least one recess is adapted to receive a corresponding one of the at least one cam follower. Each of the at least one recess lies generally in a corresponding plane parallel to the central axis. Each of the at least one recess has a first segment, a second segment and a third segment. The second segment is between the first segment and the third segment. The first segment is oriented at a first angle relative to the central axis. The second segment is oriented at a second angle relative to the central axis. The second angle is greater than the first angle. The third segment is oriented at a third angle relative to the central axis. The third angle is smaller than the second angle. The at least one can follower engages the first segment of its corresponding one of the at least one recess when the cam moves between the first and second positions to vary a pitch of the at least one propeller blade between a first pitch and a second pitch. The at least one cam follower engages the second segment of its corresponding one of the at least one recess when the cam moves between the second and third positions to vary the pitch of the at last one propeller blade between the second pitch and a third pitch.

In a further aspect, when the at least one cam follower engages the first segment of the respective one of the at least one recess, the pitch of the at least one propeller blade is such that rotation of the propeller assembly in a first direction provides thrust in a first thrust direction.

In a further aspect, when the at least one cam follower engages at least a portion of the second segment of the respective recesses, the pitch of the at least one propeller blade is such that rotation of the propeller assembly in a first direction provides thrust in a second thrust direction opposite to the first thrust direction.

In a further aspect, the at least one recess includes three recesses. The at least one propeller blade includes three propeller blades. The at least one cam follower includes three cam followers.

In a further aspect, the at least one recess includes four recesses. The at least one propeller blade includes four propeller blades. The at least one cam follower includes four cam followers.

In a further aspect, the first segment of each recess is disposed forwardly of the second segment of the respective recess.

In a further aspect, the pitch of the first and second propeller blades varies between the first pitch and the second pitch at a first rate relative to a rate of movement of the cam. The pitch of the first and second propeller blades varies between the second pitch and the third pitch at a second rate relative to a rate of movement of the cam. The second rate is greater than the first rate.

In a further aspect, the second rate is at least 5 times the first rate.

In a further aspect, the first rate is less than 1.0 degrees per 1 mm of movement of the cam.

In a further aspect, the first rate is approximately 0.3 degrees per 1 mm of movement of the cam.

In a further aspect, the second rate is greater than 1.0 degrees per 1 mm of movement of the cam.

In a further aspect, the second rate is approximately 3 degrees per 1 mm of movement of the cam.

In an additional aspect, the invention provides a method of varying a pitch of a propeller blade about a pitch axis. The propeller blade has a cam follower adapted to engage a recess of a cam. The method comprises: moving the cam in a direction generally perpendicular to the pitch axis between a first cam position and a second cam position forwardly of the first position, such that the pitch of the propeller blade varies at a first rate relative to the movement of the cam, the first rate being less than 1 degree per 1 mm of cam movement; and moving the cam in a direction generally perpendicular to the pitch axis between the second cam position and a third cam position forwardly of the second cam position, such that the pitch of the propeller blade varies at a second rate relative to the movement of the cam, the second rate being greater than the first rate.

In the present application, terms related to spatial orientation such as forwardly, rearwardly, left, and right, should be interpreted are as they would normally be understood by a driver of a watercraft sitting thereon in a normal driving position, when the engine is mounted to the stern of the watercraft. When these terms are used in relation to a propeller alone, they should be interpreted as they would be understood if the propeller were installed on a watercraft.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention, as well as other aspects and further features thereof, reference is made to the following description which is to be used in conjunction with the accompanying drawings, where.

DETAILED DESCRIPTION OF THE PREFERRED EMBODIMENTS

Figure 1:
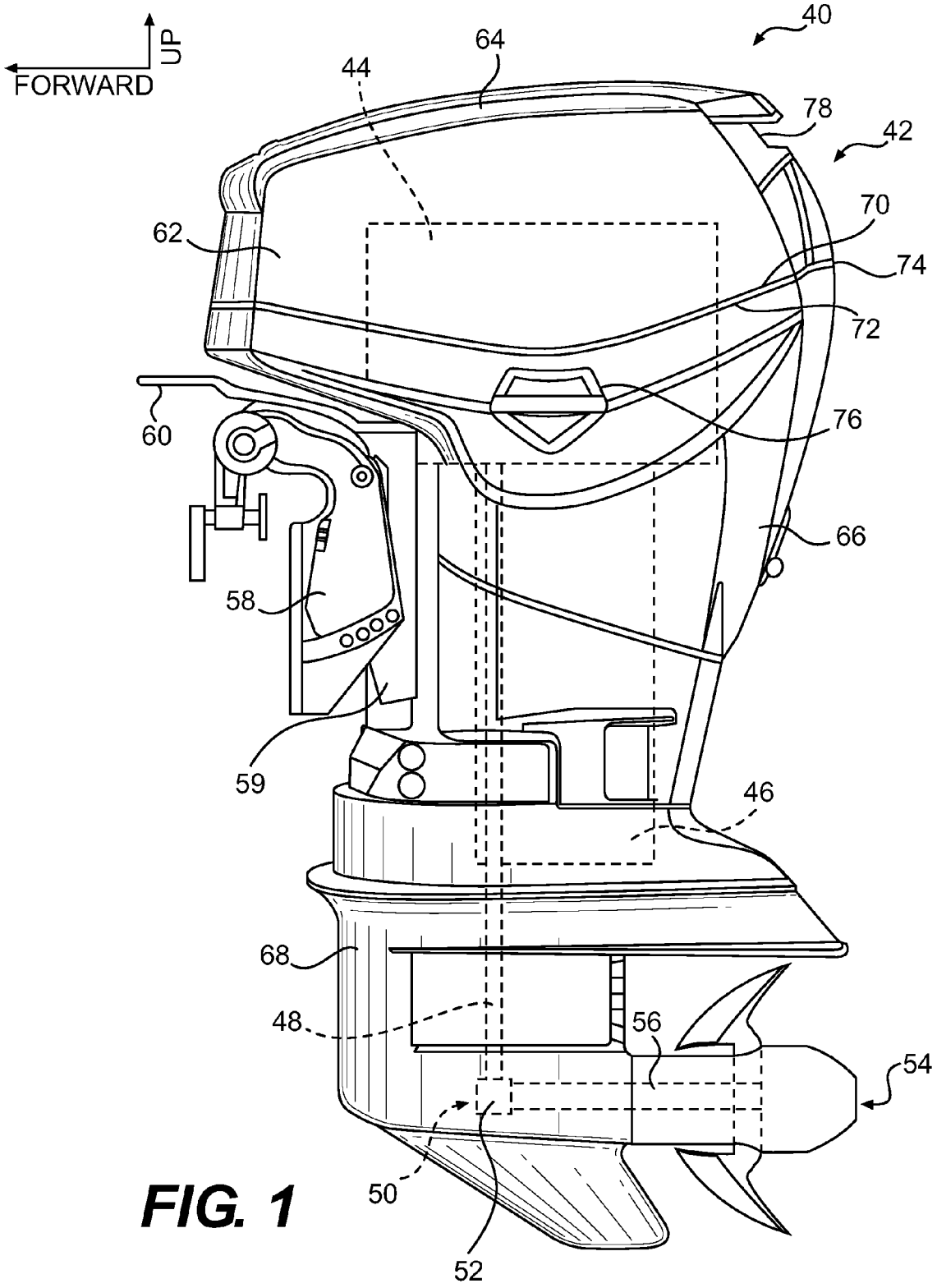
FIG. 1 is a side elevation view of a marine outboard engine having a variable pitch propeller according to the present invention.

Referring to FIG. 1, a marine outboard engine 40 will be described according to the present invention. It should be understood that the present invention is applicable to other marine applications involving propellers, such as inboard engines and stern drives.

FIG. 1 is a side view of a marine outboard engine 40 having a cowling 42. The cowling 42 surrounds and protects an engine 44, shown schematically. The engine 44 may be any suitable engine known in the art, such as an internal combustion engine. An exhaust system 46, shown schematically, is connected to the engine 44 and is also surrounded by the cowling 42.

The engine 44 is coupled to a vertically oriented driveshaft 48. The driveshaft 48 is coupled to a drive mechanism 50, which includes a transmission 52 and a bladed rotor, such as a propeller assembly 54 (shown schematically) mounted on a propeller shaft 56. The propeller shaft 56 is generally perpendicular to the driveshaft 48. The drive mechanism 50, the propeller assembly 54 and the propeller shaft 56 will be described below in further detail. Other known components of an engine assembly are included within the cowling 42, such as a starter motor and an alternator. As it is believed that these components would be readily recognized by one of ordinary skill in the art, further explanation and description of these components will not be provided herein.

A stern bracket 58 is connected to the cowling 42 via the swivel bracket 59 for mounting the outboard engine 40 to a watercraft. The stern bracket 58 can take various forms, the details of which are conventionally known.

A linkage 60 is operatively connected to the cowling 42, to allow steering of the outboard engine 40 when coupled to a steering mechanism of a boat, such as a steering wheel.

The cowling 42 includes several primary components, including an upper motor cover 62 with a top cap 64, and a lower motor cover 66. A lowermost portion, commonly called the gear case 68, is attached to the exhaust system 46. The upper motor cover 62 preferably encloses the top portion of the engine 44. The lower motor cover 66 surrounds the remainder of the engine 44 and the exhaust system 46. The gear case 68 encloses the transmission 52 and supports the drive mechanism 50, which will be described below in further detail.

The upper motor cover 62 and the lower motor cover 66 are made of sheet material, preferably plastic, but could also be metal, composite or the like. The lower motor cover 66 and/or other components of the cowling 42 can be formed as a single piece or as several pieces. For example, the lower motor cover 66 can be formed as two lateral pieces that mate along a vertical joint. The lower motor cover 66, which is also made of sheet material, is preferably made of composite, but could also be plastic or metal. One suitable composite is fiberglass.

A lower edge 70 of the upper motor cover 62 mates in a sealing relationship with an upper edge 72 of the lower motor cover 66. A seal 74 is disposed between the lower edge 70 of the upper motor cover 62 and the upper edge 72 of the lower motor cover 66 to form a watertight connection.

A locking mechanism 76 is provided on at least one of the sides of the cowling 42. Preferably, locking mechanisms 76 are provided on each side of the cowling 42.

The upper motor cover 62 is formed with two parts, but could also be a single cover. As seen in FIG. 1, the upper motor cover 62 includes an air intake portion 78 formed as a recessed portion on the rear of the cowling 42. The air intake portion 78 is configured to prevent water from entering the interior of the cowling 42 and reaching the engine 44. Such a configuration can include a tortuous path. The top cap 64 fits over the upper motor cover 62 in a sealing relationship and preferably defines a portion of the air intake portion 78. Alternatively, the air intake portion 78 can be wholly formed in the upper motor cover 62 or even the lower motor cover 66.

Figure 2:
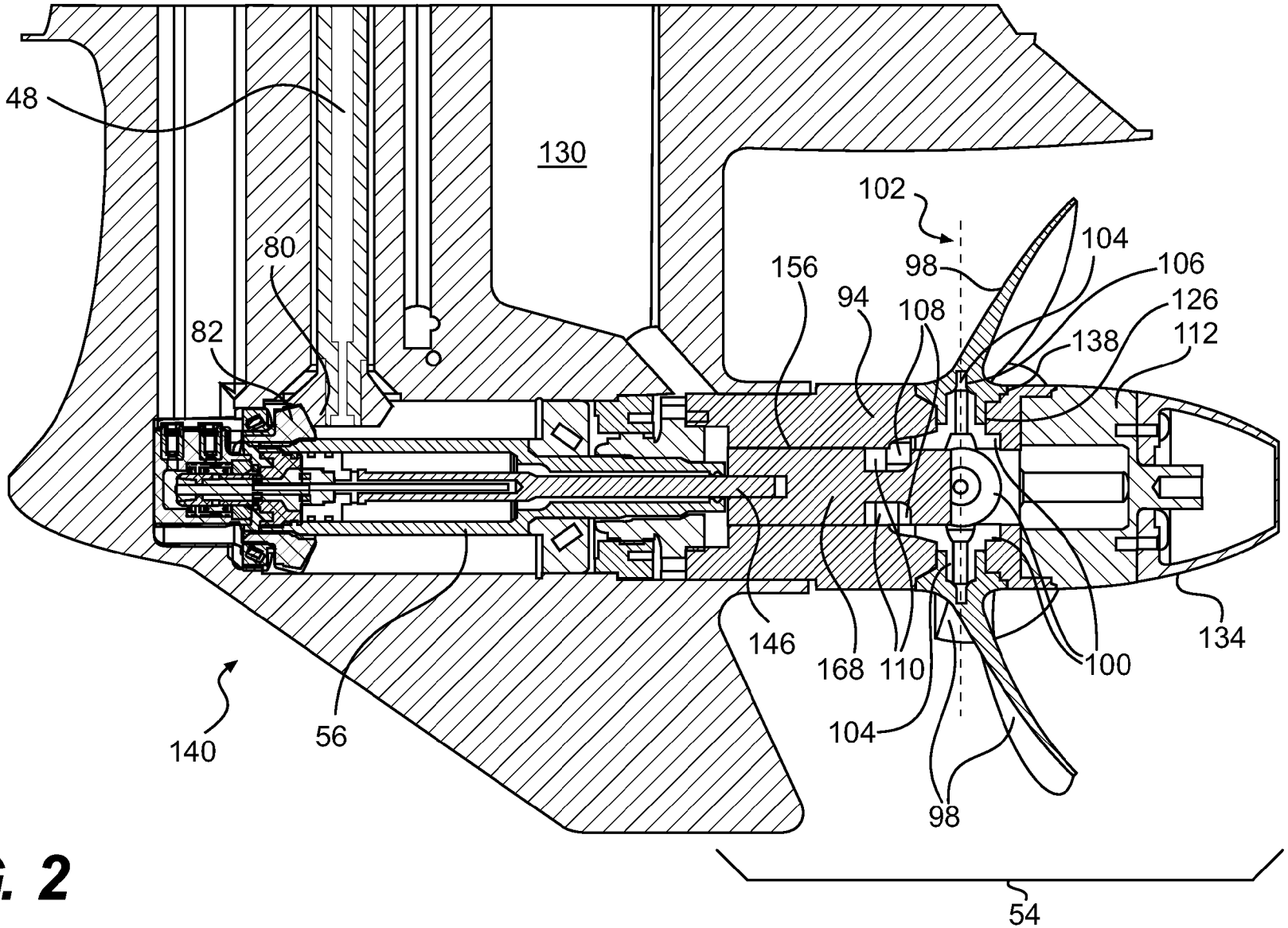
FIG. 2 is a cross-sectional view of the gear case of the outboard engine of FIG. 1.

Referring to FIG. 2, the drive mechanism 50 will now be described.

A bevel gear 80 is mounted on one end of the driveshaft 48. The bevel gear 80 meshes with the bevel gear 82 that is mounted to the propeller shaft 56. The driveshaft 48 drives the propeller shaft 56 to propel a watercraft (not shown) in either the forward direction or the reverse direction, depending on the pitch of the blades 98, as will be described below in further detail. An optional transmission assembly (not shown) is capable of disengaging the engine 44 from the bevel gear 82, resulting in a neutral state wherein the propeller shaft 56 is not driven and the watercraft is no longer propelled in a body of water and can be safely boarded from the rear. A neutral state may alternatively be achieved by varying the pitch of the blades 98, as will be discussed below in further detail.

Referring to FIG. 2, a variable pitch propeller assembly 54 will now be described.

The propeller assembly 54 includes four propeller blades 98 disposed at 90 degrees from each other, received in recesses 126 formed in the hub 94. Sealing rings 138 provide a water-tight seal between the hub 94 and the blades 98. Each blade 98 has a corresponding cam follower assembly 100. A D-shaped or otherwise non-circular end 104 of the cam follower assembly 100 is received in a complementarily-shaped aperture 106 in the corresponding blade 98, such that rotating the cam follower assembly 100 causes the blade 98 to pivot about the pivot axis 102 to vary the pitch of the blade 98. In this configuration, each pair of blades 98 on opposite sides of the hub 94 has coaxial pivot axes 102. It is contemplated that the blade 98 may be connected to the cam follower assembly 100 by any other suitable connection, such as a spline connection. It is further contemplated that the cam follower assembly 100 may be formed integrally with the blade 98 in a one piece construction. Each cam follower assembly 100 has a cam follower 108 that is received in a corresponding recess 110 in the cam 168. The cam follower assemblies 100 are rotated by the cam 168 in a manner that will be described in further detail below. It should be understood that more or fewer than four propeller blades 98 may be used, in which case the cam 168 would have a recess 110 corresponding to each propeller blade 98.

A spacer 112 is bolted to the rear portion of the hub 94, to allow an increased range of motion for the cam 168, as will be described in further detail below. A cap 134 is received in the rear portion of the spacer 112. The cap 134 improves the aesthetic and hydrodynamic properties of the propeller assembly 54, and provides a path for exhaust from the exhaust chamber 130 to exit via channels (not shown) in the hub 94, and spacer 112.

Figure 3:
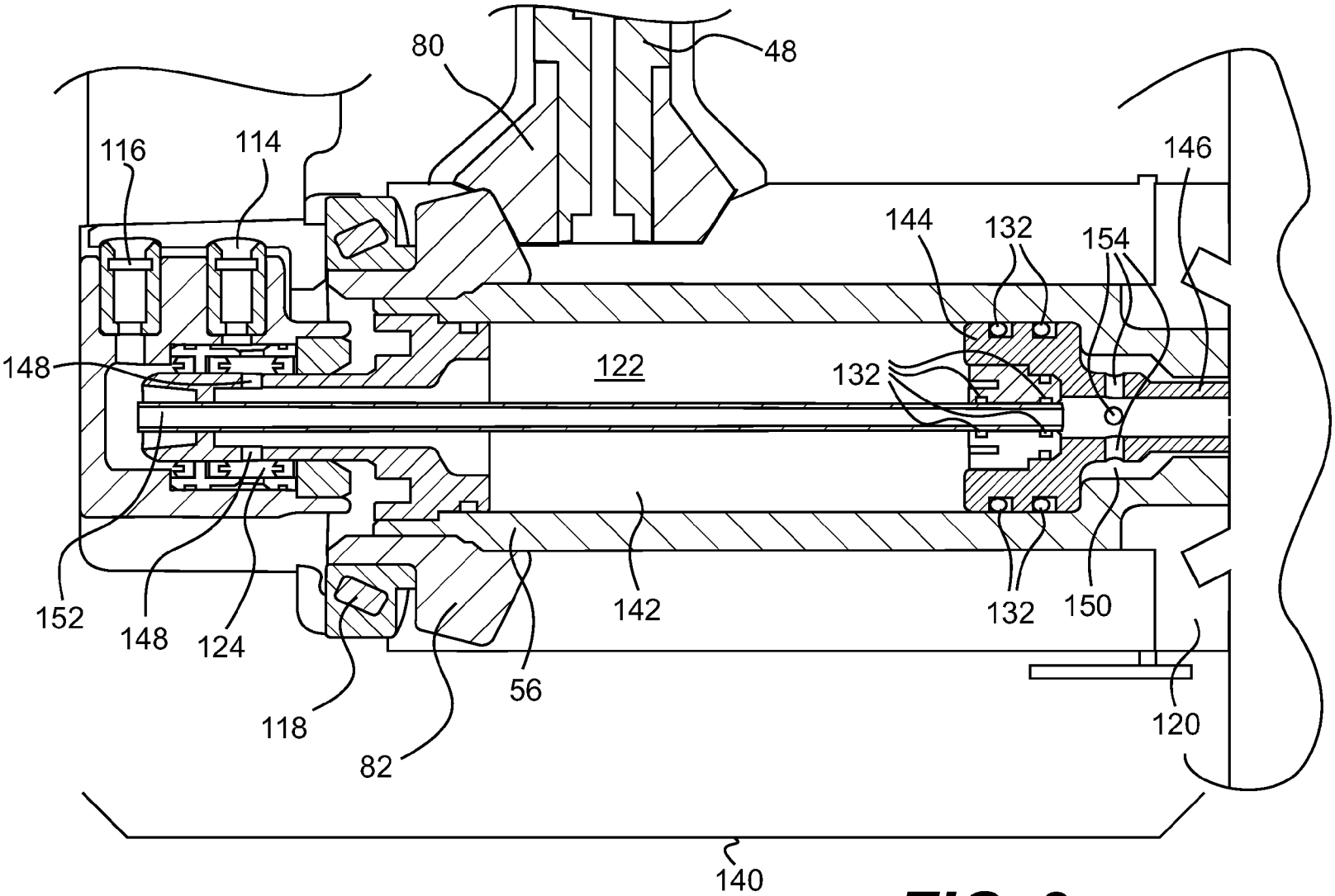
FIG. 3 is a close-up view of the gear case of FIG. 2, showing the piston in a different position.

Referring now to FIG. 3, the variable pitch system will now be described.

The variable pitch system is operated by an actuator 140 in the form of a linear hydraulic actuator. The actuator 140 includes a housing 142 formed inside the propeller shaft 56, a piston 144 that can reciprocate within the housing 142, a shaft 146 fixed to the piston 144, and a cam 168 (FIG. 2) fixed to the rearward end of the shaft 146. The actuator 140 is coupled to a set of hydraulic valves 114 and 116, and is supported by tapered bearings 118 and 120. The hydraulic valves 114, 116 are preferably controlled by an electronic control unit (ECU, not shown) to ensure precise operation of the actuator 140. The hydraulic valve 114 permits hydraulic fluid to enter the chamber 122 via the annular channel 124 and the apertures 148, to urge the piston 144 rearwardly toward the position shown in FIG. 3. The hydraulic valve 116 permits hydraulic fluid to enter the chamber 150 via the hydraulic line 152 and the apertures 154, to urge the piston 144 forwardly toward the position shown in FIG. 2. It should be understood that the valves 114, 116 could be placed at any suitable location. It is contemplated that a valveless hydraulic actuator could alternatively be used, for example by replacing the valves 114, 116 with connections to a reversible hydraulic motor. Operation of the reversible hydraulic motor in one direction would cause fluid to enter the chamber 122, and operation of the reversible hydraulic motor in the reverse direction would cause fluid to enter the chamber 150. Sealing rings 132 provide a seal between the piston 144, the chamber 122 and the hydraulic line 152.

The reciprocating movement of the piston 144 drives the shaft 146, which extends through an end of the housing 142 to the hub 94 to drive the cam 168. The hub 94 and spacer 112 together form a channel 156 (FIG. 2) in which the cam 168 reciprocates. It is contemplated that any other suitable type of actuator 140 may alternatively be used.

The cam 168 is preferably made of plastic, but could also be made of metal, composite or the like.

Figure 4:
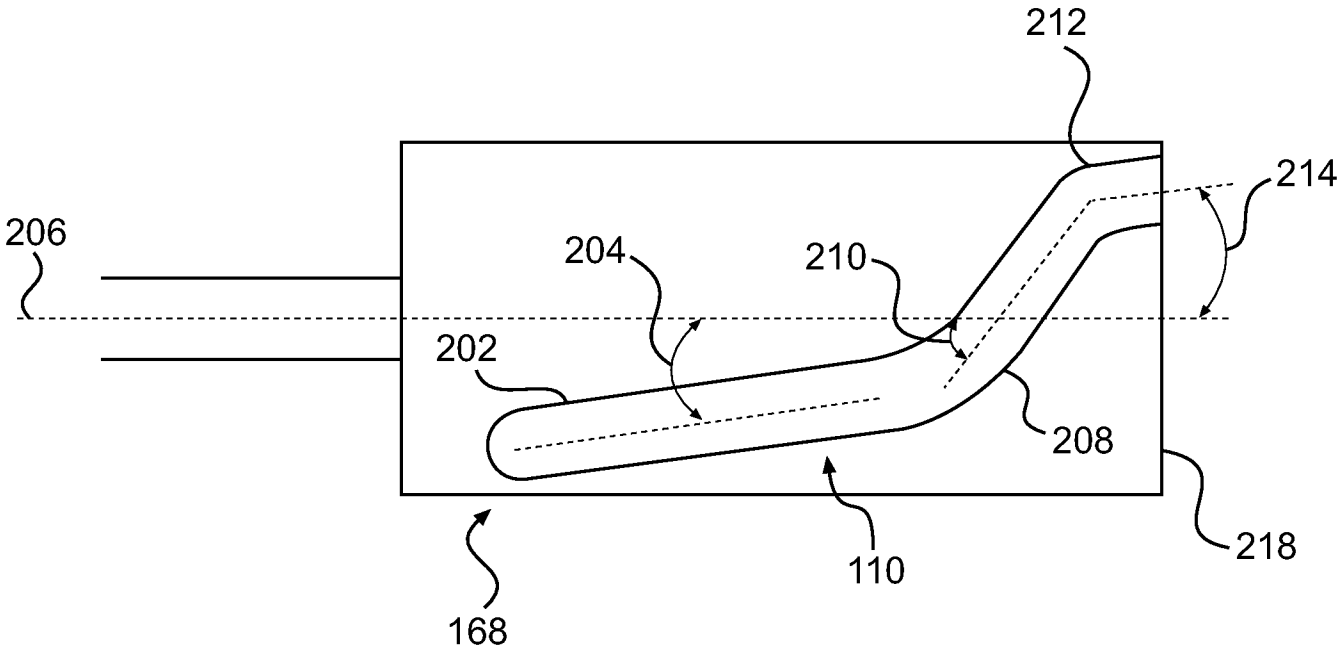
FIG. 4 is a plan view of a cam of a propeller assembly according to the present invention.

Referring now to FIG. 4, the cam 168 has four recesses 110 formed therein, corresponding to the four blades 98. A first segment 202 of the recess 110 is oriented at a first angle 204 relative to the axis 206 of the propeller shaft 56. A second segment 208 of the recess 110, disposed rearwardly of the first segment 202, is oriented at a second angle 210 relative to the axis 206 of the propeller shaft 56. A third segment 212 of the recess 110, disposed rearwardly of the second segment 208, is oriented at a third angle 214 relative to the axis 206 of the propeller shaft 56. The second angle 210 is greater than each of the first angle 204 and the third angle 214. Each cam follower 108 is received in, and engages, a corresponding recess 110. It should be understood that a propeller assembly 54 having more or fewer than four blades 98 would have a cam 168 with a corresponding number of recesses 110. For example, the propeller assembly 54 may have three blades 98 evenly spaced around the hub 94, and a three-sided cam 168 having three corresponding recesses 110.

Figure 5A:
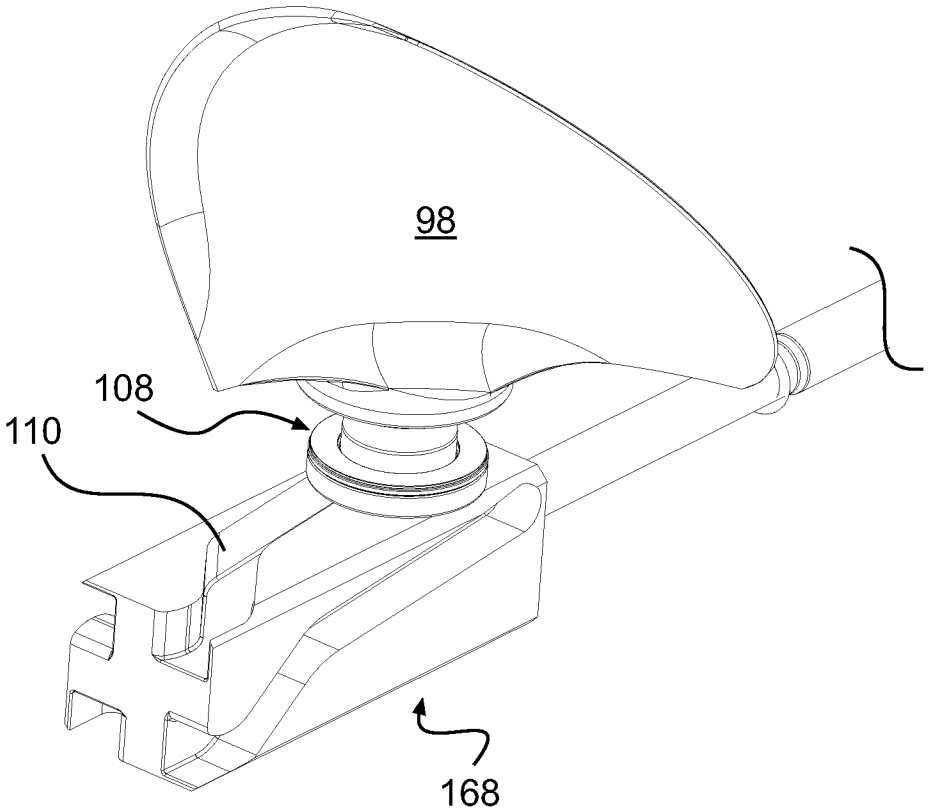
FIGS. 5A-5C are right rear perspective views of a propeller assembly showing the cam in first, second and third positions respectively.
Figure 5B:
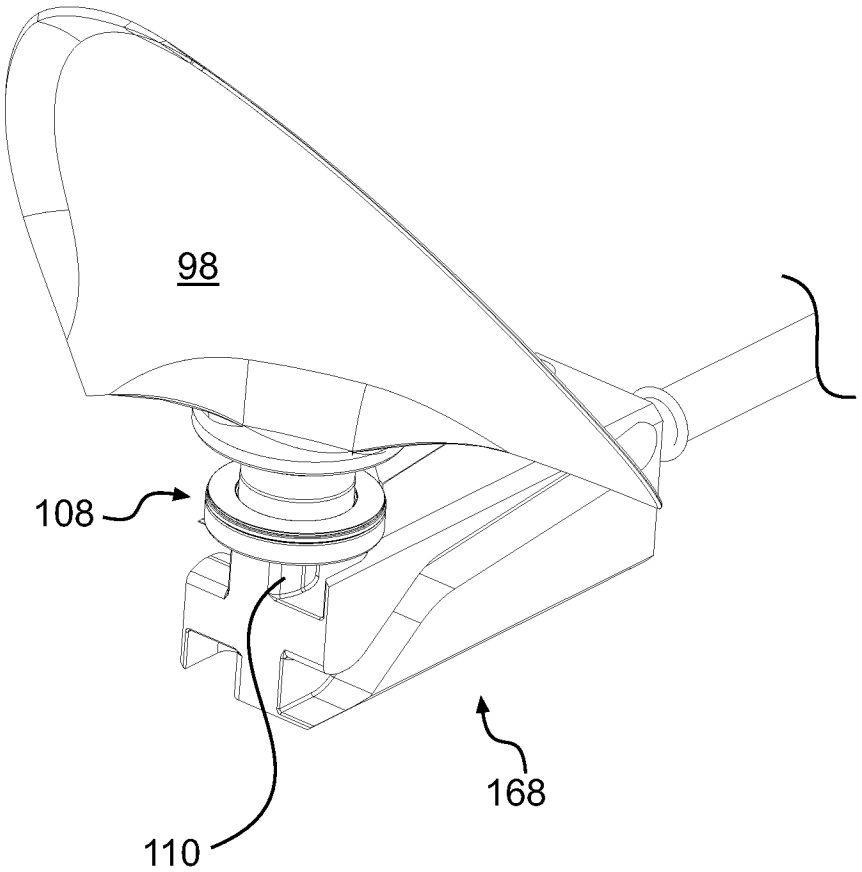
Figure 5C:
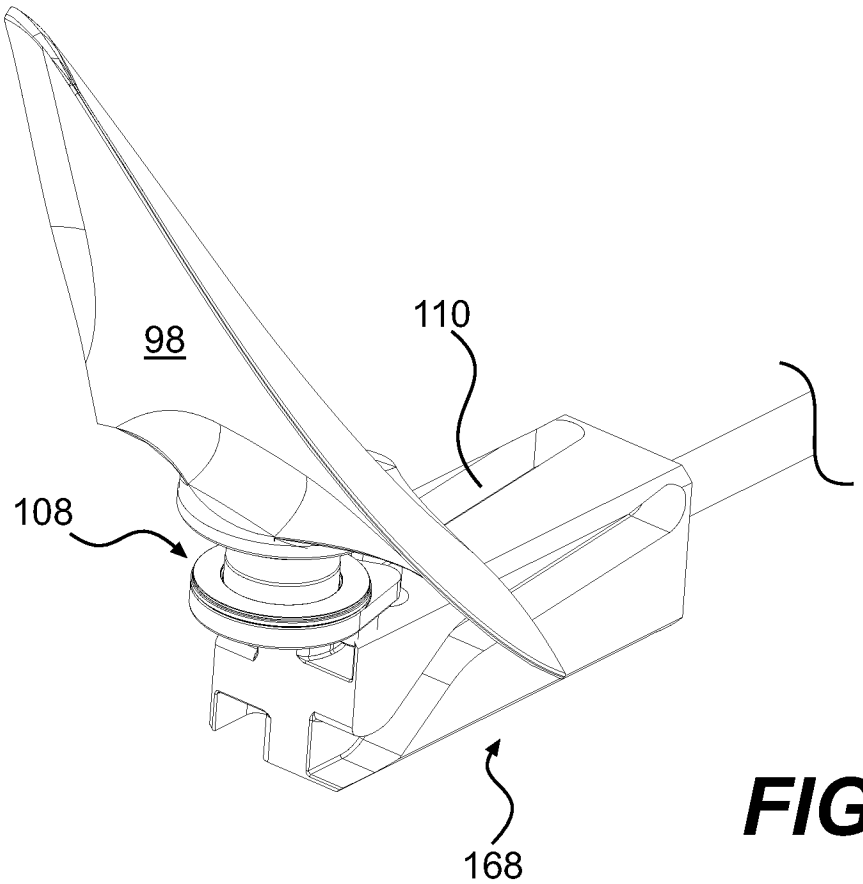

Referring to FIGS. 5A, 5B and 5C, as the cam 168 reciprocates within the channel 156 (shown in FIG. 2), the portion of the recess 110 in contact with the corresponding cam follower 108 causes the cam follower 108 to rotate and thereby vary the pitch of the corresponding blade 98. When the cam 168 is forwardly of a first position (shown in FIG. 5A) and rearwardly of a second position (shown in FIG. 5B), the cam follower 108 engages the first segment 202 of the cam 168. The relatively shallow first angle 204 causes the pitch of the blade 98 to vary relatively slowly as the cam 168 moves between the first position and the second position. The pitch of the blade 98 varies at a first rate that is preferably less than 1 degree per 1 mm of travel of the cam 168, and is even more preferably approximately 0.3 degrees per 1 mm of travel of the cam 168. This permits fine adjustments of the pitch of the blades 98, to achieve the desired performance characteristics while propelling the watercraft in the forward direction.

When the cam 168 is forwardly of the second position and rearwardly of a third position (shown in FIG. 5C), the cam follower 108 engages the second segment 208 of the cam 168. The relatively steep second angle 210 causes the pitch of the blade 98 to vary relatively quickly as the cam 168 moves between the second position and the third position. The pitch of the blade 98 varies at a second rate that is preferably greater than 1 degree per 1 mm of travel of the cam 168, and is even more preferably up to 3 degrees per 1 mm of travel of the cam 168. The second rate is preferably at least 5 times as fast as the first rate, and is even more preferably up to 15 times as fast as the first rate. This permits rapid shifting of the pitch of the blades 98 between the second position, in which the watercraft is propelled in the forward direction, and the third position, in which the watercraft is propelled in the reverse direction. In this manner, the watercraft can quickly and conveniently be propelled in the reverse direction by varying the pitch of the blades 98 without changing the direction of rotation of the propeller assembly 54. The increased rate of pitch change between the second and third positions reduces the degree of travel of the cam 168, allowing for a more compact arrangement.

It should be understood that there exists a pitch of the blades 98 corresponding to a zero thrust point, at which the rotation of the propeller assembly 54 provides no thrust in either of the forward or reverse directions. The zero thrust point occurs between the pitch range in which the watercraft is propelled in the forward direction and the pitch range in which the watercraft is propelled in the reverse direction, when the cam 168 is between the second position and the third position. A neutral state may therefore be achieved by setting the pitch of the blades 98 to the zero thrust pitch, without turning off the engine 44 or disengaging the engine 44 from the propeller assembly 54.

When the cam 168 is positioned forwardly of the third position, the cam follower 108 engages the third segment 212 of the cam 168. In this position, the rotation of the propeller assembly 54 propels the watercraft in the reverse direction, and the pitch of the blades 98 varies at a third rate that is less than the second rate. The third segment 212 extends to the end 216 of the cam 168, to allow the propeller assembly 54 to be assembled by sliding the cam followers 108 through the end 216 of the cam 168 into their respective recesses 110. The third angle 214 is preferably parallel to the propeller shaft, to allow for simple assembly, in which case the third rate is zero.

Referring to FIGS. 6 to 12, alternative embodiments of the variable pitch systems will be described. For simplicity and ease of understanding, parts of the alternative embodiments below that are similar to those shown in FIGS. 1 to 5*c* and that function similarly to those described in those figures are referenced by the same reference numbers and will not be described again in detail.

One alternative embodiment of the variable pitch system is shown in FIGS. 6 to 9. The variable pitch system is operated by an actuator 300 (FIG. 6) in the form of a linear hydraulic actuator. It is contemplated that the linear hydraulic actuator 300 could be replaced by a pneumatic or an electric actuator.

Figure 6:
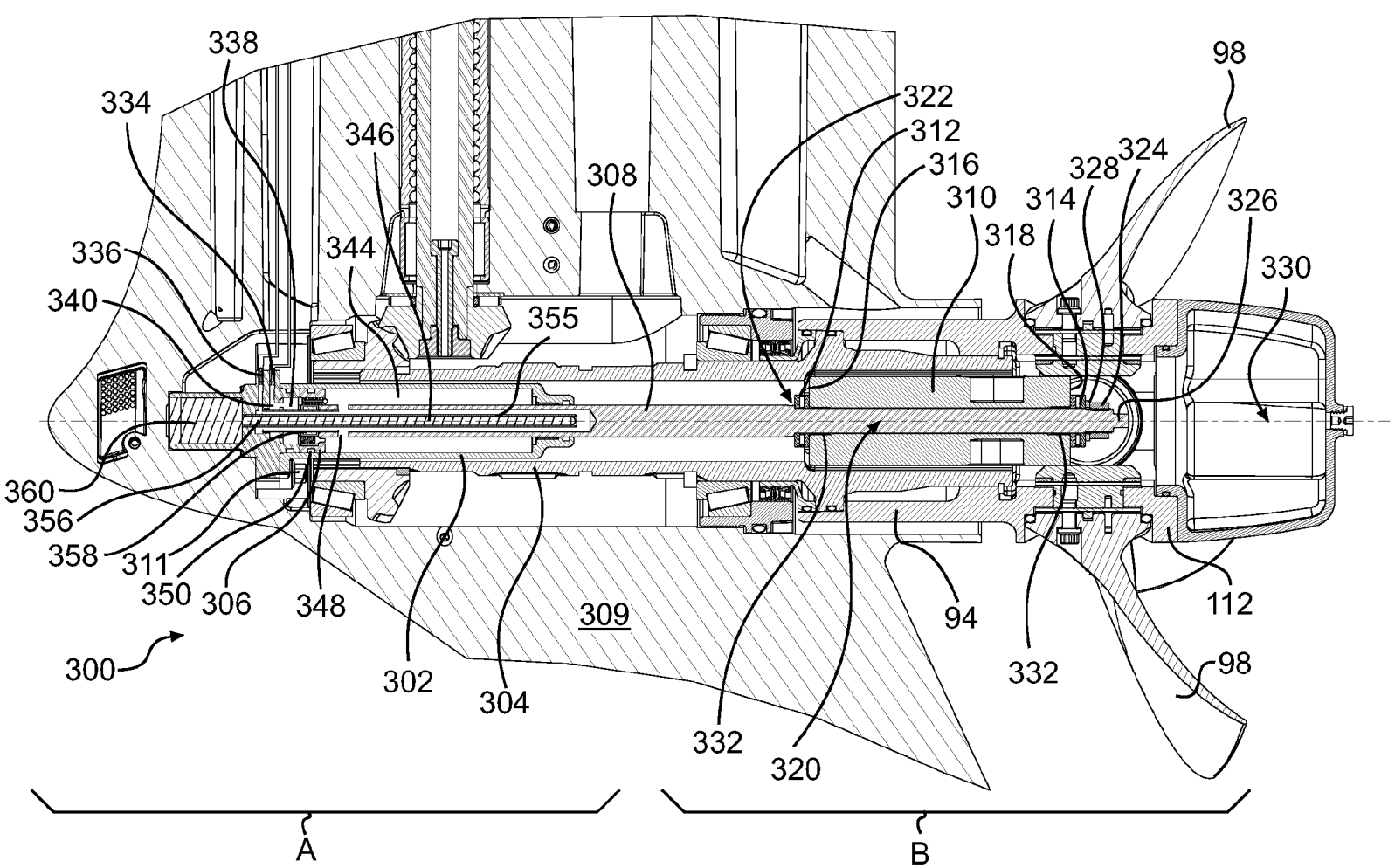
FIG. 6 is a cross-sectional view of an alternative embodiment of a variable pitch propeller system of the outboard engine of FIG. 1.

Referring to FIG. 6, the actuator 300 includes a cylindrical housing 302, a piston 306, an actuator shaft 308 and a cam 310. The cylindrical housing 302 is disposed inside a propeller shaft 304. The piston 306 can reciprocate within the housing 302. The actuator shaft 308 is fixed to the piston 306. The cam 310 (FIGS. 6 and 8) is connected to the actuator shaft 308 via bearings 312 and 314 as described below. It is contemplated that the housing 302 may be of a shape other than cylindrical.

Figure 8:
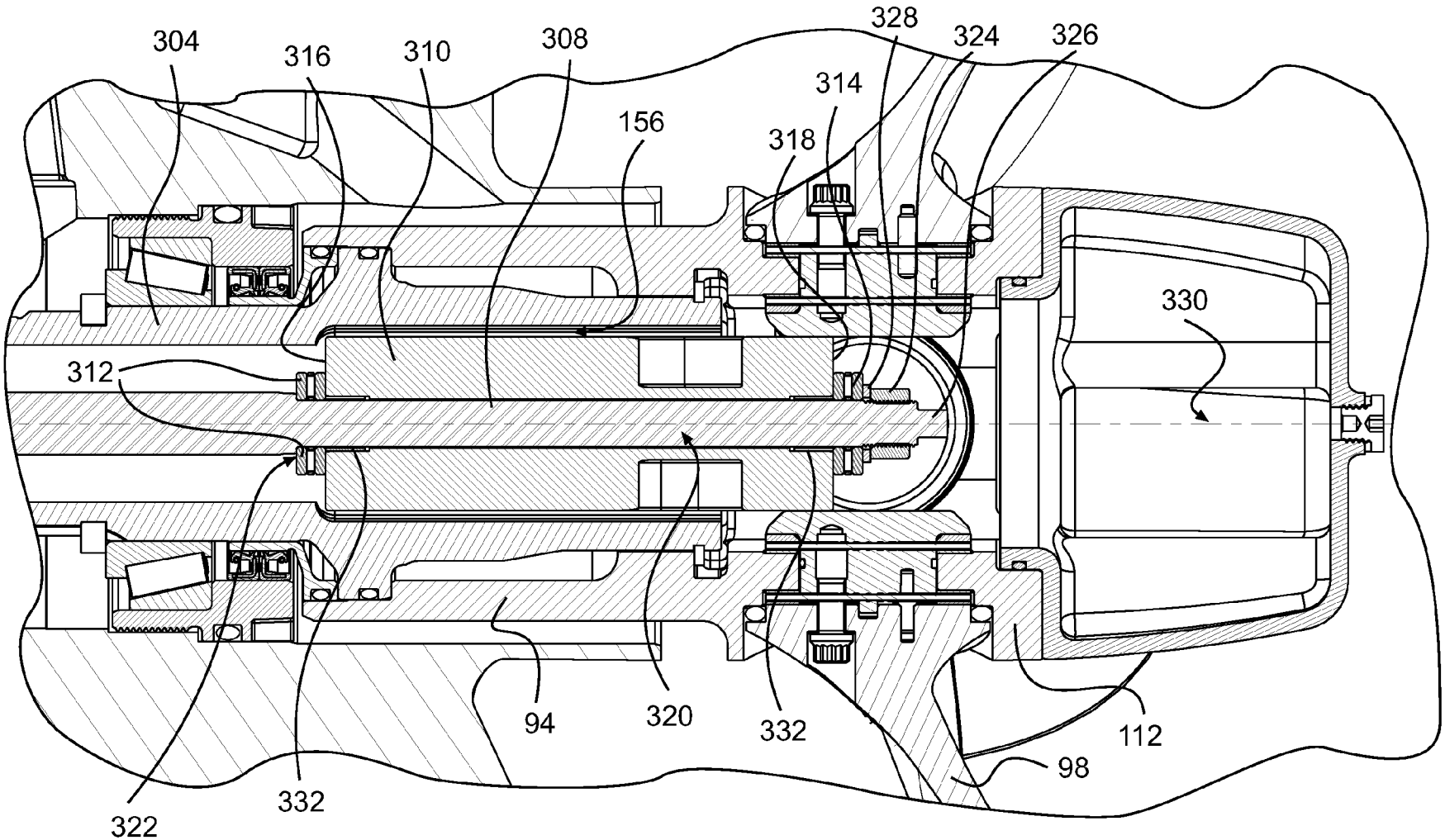
FIG. 8 is a close-up view of a portion the variable pitch propeller system of FIG. 6, indicated by bracket B.

As best seen in FIG. 8, the actuator shaft 308 extends through an aperture 320 in the cam 310 from a forward end 316 of the cam 310 to a rearward end 318 of the cam 310. The aperture 320 has a diameter which is larger than a diameter of a portion of the actuator shaft 308 passing through the cam 310, thus allowing the actuator shaft 308 and the cam 310 to rotate freely with respect to each other about an actuator shaft axis 330.

The bearing 312 is disposed onto the actuator shaft 308 against a shoulder 322 of the actuator shaft 308 and against the forward cam end 316, such that the bearing 312 is held between the shoulder 322 and the forward cam end 316. The bearing 312 provides a rotatable connection between the actuator shaft 308 and the forward cam end 316.

The bearing 314 is disposed onto the actuator shaft 308 against the rearward cam end 318. The bearing 314 is secured to the actuator shaft 308 via a nut 324 which is screwed onto a rearward actuator shaft end 326 holding the bearing 314 between the rearward cam end 318 and the nut 324. A washer 328 is disposed between the bearing 314 and the nut 324. The bearing 314 provides a rotatable connection between the actuator shaft 308 and the rearward cam end 316.

Figure 7:
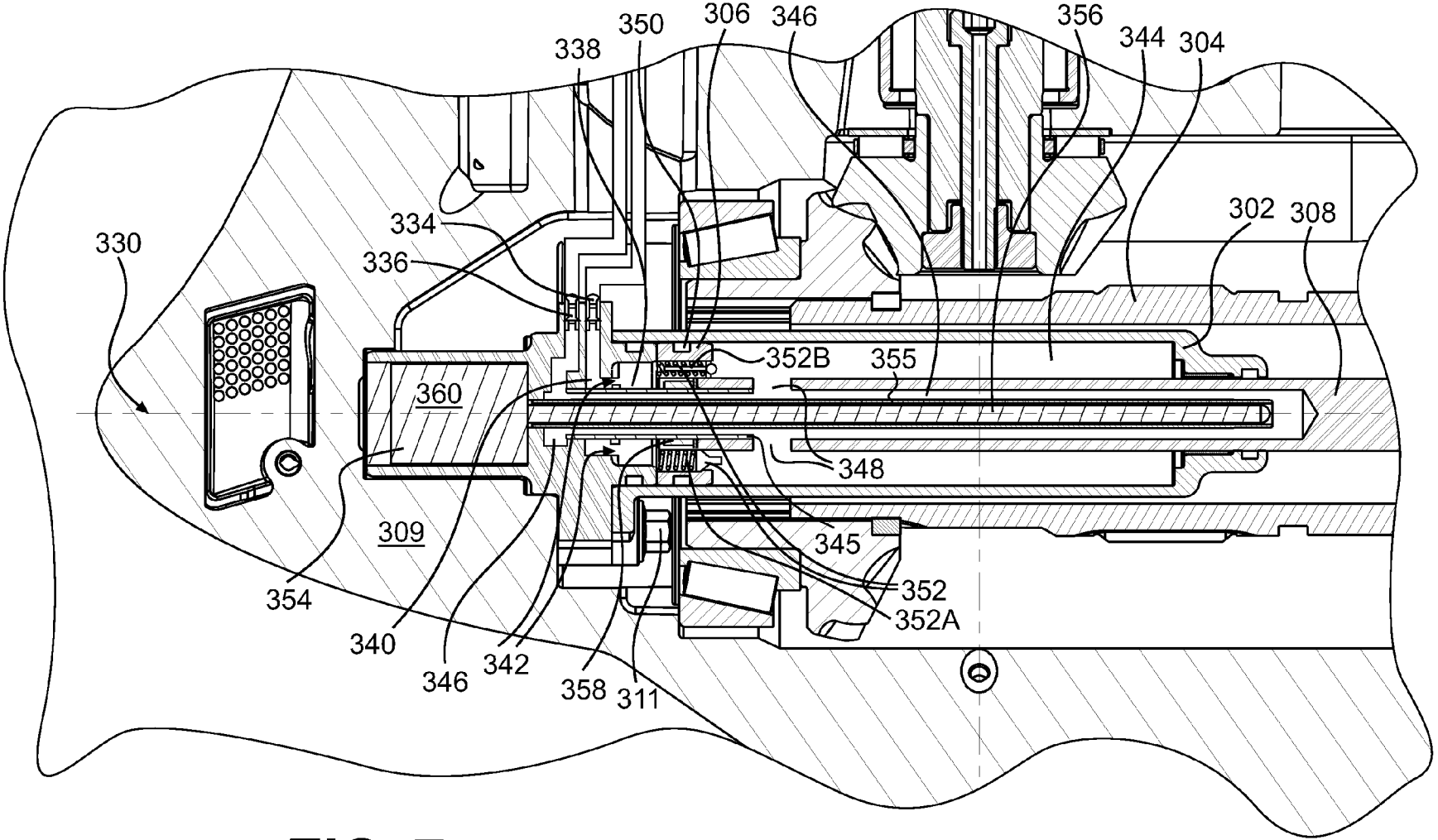
FIG. 7 is a close-up view of a portion of the variable pitch propeller system of FIG. 6, indicated by bracket A.

As a result, the cam 310 is held between the two bearings 312 and 314, which are in turn held between the shoulder 322 of the actuator shaft 308 and the nut 324. Therefore, the actuator shaft 308 and the cam 310 are secured together such that the actuator shaft 308 and the cam 310 are rotatable relative to each other and such that the actuator shaft 308 and the cam 310 are able to reciprocate simultaneously along the actuator shaft axis 330 when the actuator shaft 308 is driven by the piston 306. Therefore, the cam 310 can rotate together with the propeller shaft 304 while the piston 306 and the actuator shaft 308 do not rotate. Additionally, as the actuator housing 302 is connected the gear case 309 via fasteners 311 (FIG. 7). It is contemplated that the piston 306 and the actuator shaft 308 may rotate slightly due to friction in the bearings 312 and 314, however the speed of rotation of the housing 302, of the piston 306 and of the actuator shaft 308 would be less than the speed of rotation of the cam 310 and the propeller shaft 304.

To further enhance the ability of the actuator shaft 308 and the cam 310 to rotate relative to each other, two plain bearings 332 are disposed in the aperture 320 at the forward and rearward cam ends 316 and 318, respectively, between the actuator shaft 308 and the cam 310. It is contemplated that the plain bearings 332 may be omitted. It is contemplated that the plain bearings 332 may be bushings, needle bearings or other types of bearings.

In the present embodiment, the bearings 312 and 314 are thrust bearings that can carry an axial load, however, it is contemplated that other types of bearings may be used to rotatably connect the actuator shaft 308 and the cam 310. It is also contemplated that no bearings may be used to rotatably secure the actuator shaft 308 and the cam 310. In a case where no bearings are used, the actuator shaft 308 and the cam 310 are rotatable relative to each other due to low friction between the materials used to manufacture the actuator shaft 308 and the cam 310.

Referring to FIG. 7, the actuator 300 is coupled to a set of hydraulic valves 334 and 336. The hydraulic valves 334, 336 are preferably controlled by an electronic control unit (ECU, not shown) to ensure precise operation of the actuator 300. The hydraulic valve 334 permits hydraulic fluid to enter the chamber 338 via the annular channel 340 and the apertures 342, to urge the piston 306 rearwardly toward the propeller blades 98. It is understood that where the actuator 300 is a pneumatic actuator, the hydraulic fluid is replaced by a gas.

The hydraulic valve 336 permits hydraulic fluid to enter the chamber 344 via a hydraulic line 346 and the apertures 348, to urge the piston 306 forwardly, away the propeller blades 98, toward the position shown in FIG. 6. The apertures 348 are holes formed in the actuator shaft 308. The hydraulic line 346 passes through a cylindrical hollow center of the actuator shaft 308, between a cylindrical sleeve 345 and a cylindrical sleeve 355, which encloses a sensor rod 356 as described in more detail below. It is contemplated that the hydraulic line 346 may be disposed at least in part between the housing 302 of the hydraulic actuator 300 and the actuator shaft 308. It is contemplated that the hydraulic line 346 may be disposed at least in part between the housing 302 and the propeller shaft 304. Sealing rings 350 provide a seal between the piston 306, the chamber 338 and the chamber 344.

It should be understood that the valves 334 and 336 could be placed at any suitable location. It is contemplated that a valveless hydraulic actuator could alternatively be used, for example by replacing the valves 334 and 336 with connections to a reversible hydraulic motor. Operation of the reversible hydraulic motor in one direction would cause fluid to enter the chamber 338, and operation of the reversible hydraulic motor in the reverse direction would cause fluid to enter the chamber 344.

Similar to the embodiment shown in FIGS. 1 to 5*c* described above, the reciprocating movement of the piston 306 drives the actuator shaft 308, which extends through an end of the housing 302 to and through the cam 310, and accordingly drives the cam 310 along an actuator shaft axis 330. The cam 310 reciprocates in the channel 156 which is formed by the propeller shaft 304, the hub 94 and the spacer 112 as shown in FIG. 8. The movement of the cam 310 controls the pitch of the blades 98 similarly to the way described above.

Also, when the propeller shaft 304 rotates, it rotates the hub 94, which in turn rotates the cam 310. Since the cam 310 is rotatable relative to the actuator shaft 308, the propeller shaft 304 and the hub 94 are also rotatable relative to the actuator shaft 308. Furthermore, in the present embodiment, the propeller shaft 304, the hub 94 and the cam 310 are rotatable relative to the piston 306 and the housing 302 of the actuator 300 which are interconnected.

To minimize system reaction time in time of drastic operating changes, for instance when a blade 98 of a marine outboard engine, such as the outboard engine 40 (FIG. 1), hits a floating object or an object in shallow water, thus creating a force which could potentially damage the blades 98, bleed valves 352 are mounted on the piston 306. Bleed valves 352 aid in increasing the speed of displacement of the piston 306 from one position to another, thus increasing the rate of pitch change of the blades 98, and the bleed valves 352 reduce pump demands when the hydraulic actuator 300 is at full stroke.

Figure 9:
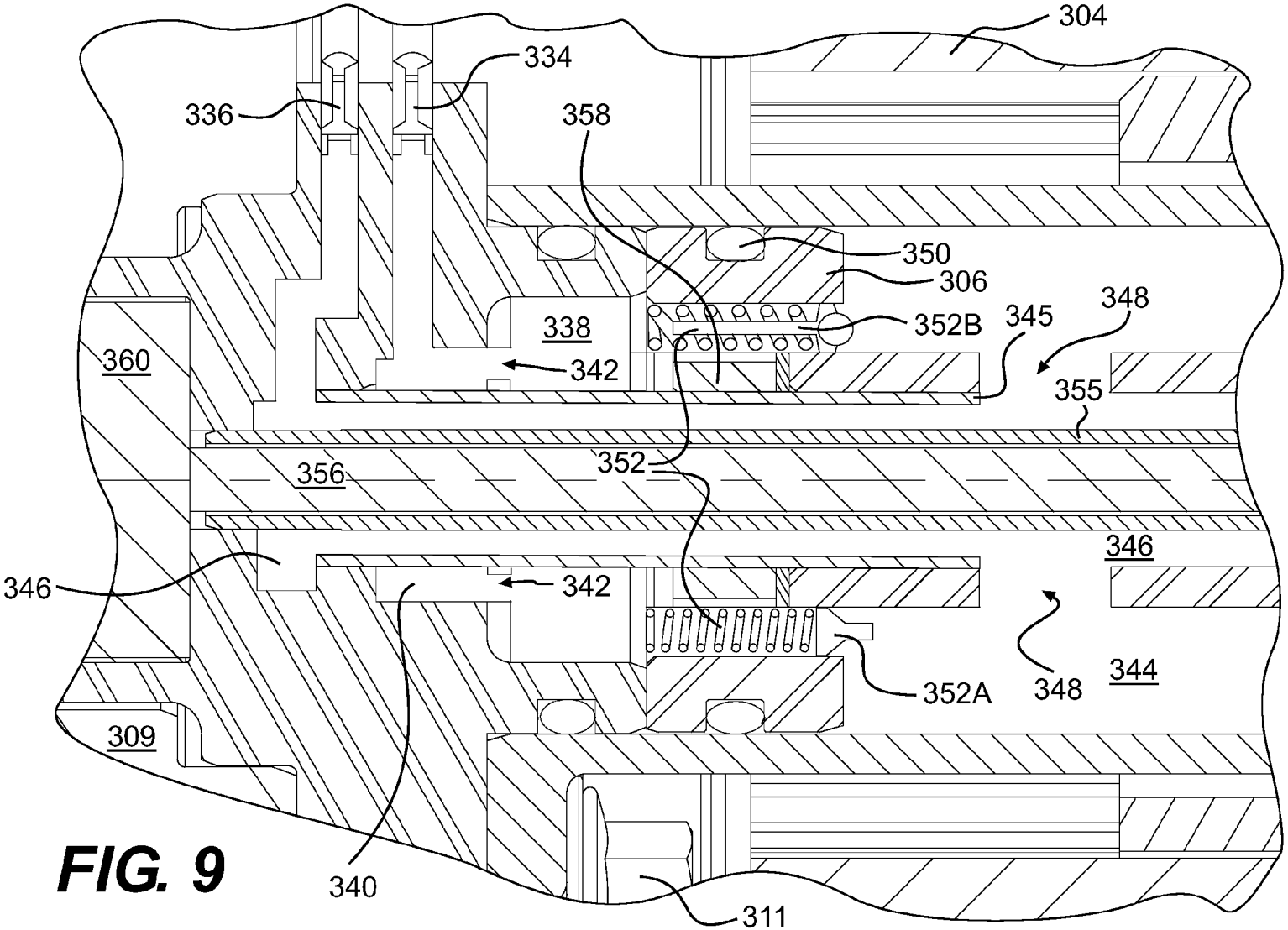
FIG. 9 is a close-up view of a piston region of the variable pitch propeller system of FIG. 6, showing valves in the piston.

Referring to FIG. 9, there are two bleed valves 352 disposed within the piston 306. The bleed valves 352 selectively fluidly communicate the chambers 338 and 344 disposed on opposite ends of the piston 306. When one of the valves 352, valve 352A, hits a wall of the housing 302, it opens, thus allowing the hydraulic fluid to flow from the chamber 338 to the chamber 344 and facilitating the displacement of the piston 306 away from the propeller blades 98.

The other valve 352B opens when the pressure in the chamber 344 is higher than a predetermined allowable pressure, thus allowing hydraulic fluid to flow from the chamber 344 to the chamber 338 and facilitating the displacement of the piston 306 towards the propeller blades 98.

It is contemplated that both of the bleed valves 352A and 352B may be the same type of bleed valves. It is also contemplated that there may be more than two bleed valves 352 or there may be only one bleed valve 352. It is also contemplated that the bleed valves 352 may be omitted.

Referring back to FIG. 7, the actuator 300 is connected to a sensor 354. In the present embodiment, the sensor 354 is a C-Series Core Sensor distributed by Temposonics®. However, it is contemplated that any suitable sensor may be used instead of the C-Series Core Sensor. The sensor 354 has a sensor rod 356 that extends through the center of the actuator shaft 308 within the cylindrical sleeve 355, which protects the sensor rod 356 from the hydraulic fluid. The sensor 354 also has a ring magnet 358 fixed to the piston 306 around the sensor rod 356.

The sensor rod 356 extends from a sensor reader 360 to the rearward end of the housing 302. The sensor rod 356 is not attached to the actuator shaft 308 and the actuator shaft 308 can move freely along the sensor rod 356. As the piston 306 reciprocates and drives the actuator shaft 308, the ring magnet 358 reciprocates with the piston 306. Reciprocation of the ring magnet 358 along the sensor rod 356 allows the sensor reader 360 to read the position of the ring magnet 358, and consecutively of the piston 306, with respect to the sensor rod 356 at any moment in time. Since the blade pitch of the blades 98 depends on the position of the piston 306, a computer (not shown) can determine the blade pitch at any moment in time from the readings of the sensor reader 360.

Figure 10:
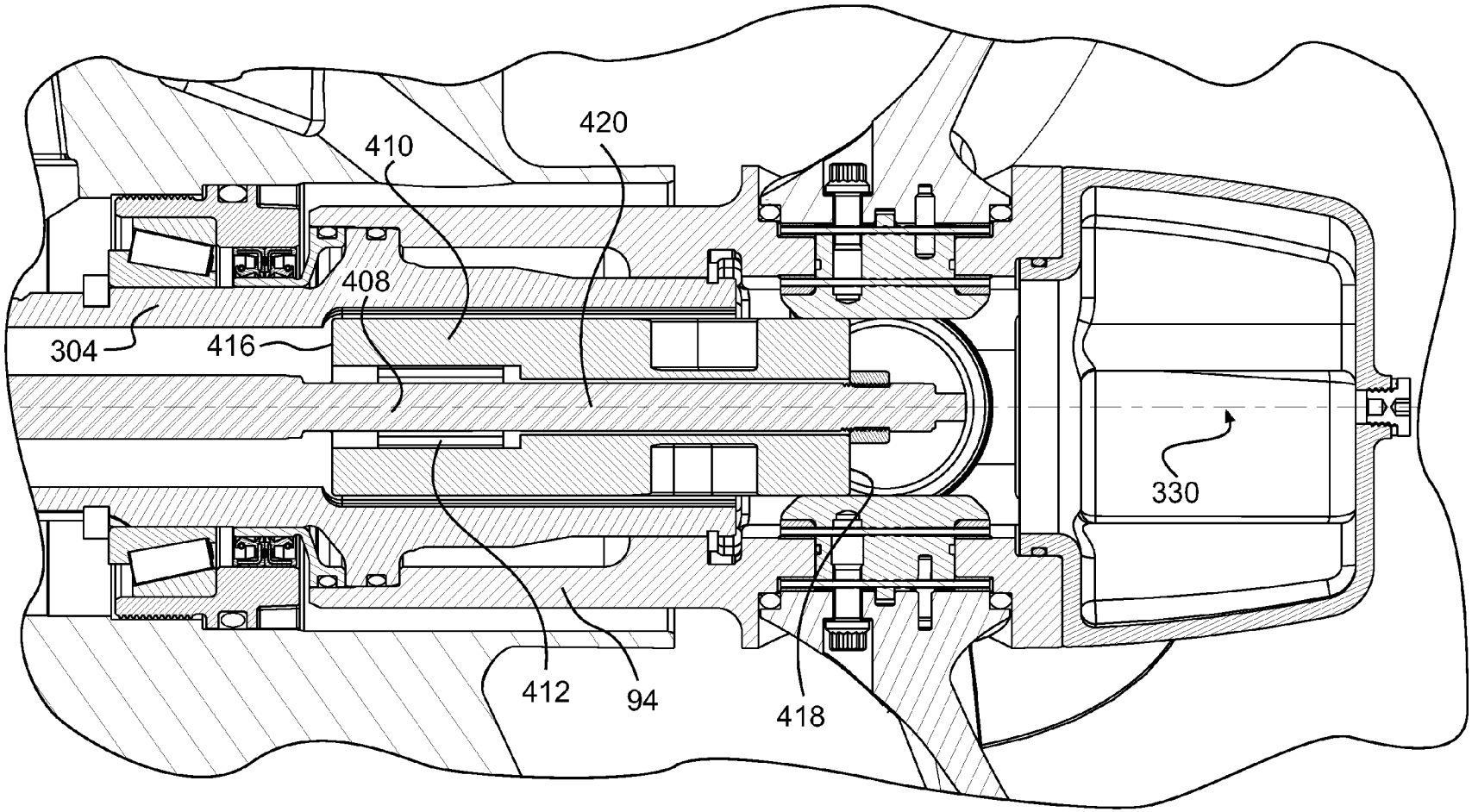
FIG. 10 is a close-up view of a cam region of an alternative embodiment of variable pitch propeller system.

An alternative way of rotatably connecting an actuator shaft, namely actuator shaft 408, and a cam, namely cam 410, is shown in FIG. 10. For simplicity and ease of understanding, parts of this alternative embodiment that are similar to those shown in FIGS. 1 to 8 and that function similarly to those described in those figures are referenced by the same reference numbers and will not be described again in detail.

The actuator shaft 408 extends through an aperture 420 in the cam 410 from a forward end 416 of the cam 410 to a rearward end 418 of the cam 410. The aperture 420 has a diameter which is larger than a diameter of a portion of the actuator shaft 408 passing through the cam 410, thus allowing the actuator shaft 408 and the cam 410 to rotate freely with respect to each other.

A bearing 412 is press-fitted onto the actuator shaft 408 in the aperture 420, such that the bearing 412 is held between the actuator shaft 408 and an inner wall, defined by the aperture 420 of the cam 410. The bearing 412 provides a rotatable connection between the actuator shaft 408 and the cam 410. It is contemplated that the bearing 412 may be otherwise secured onto the actuator shaft 408. It is also contemplated that the actuator shaft 408 may extend only in part inside the cam 408. The bearing 412 is a needle bearing. However, it is contemplated that bearing 412 may be any suitable type of bearing.

A result of bearing 412 being held between the actuator shaft 408 and the inner wall defined by the aperture 420 of the cam 410, the actuator shaft 408 and the cam 410 are rotatably connected together, such that the actuator shaft 408 and the cam 410 are rotatable relative to each other, and such that the actuator shaft 408 and the cam 410 are able to reciprocate simultaneously along the actuator shaft axis 330 when the actuator shaft 408 is moved via the piston 306 similarly to the embodiments described above.

Figure 11:
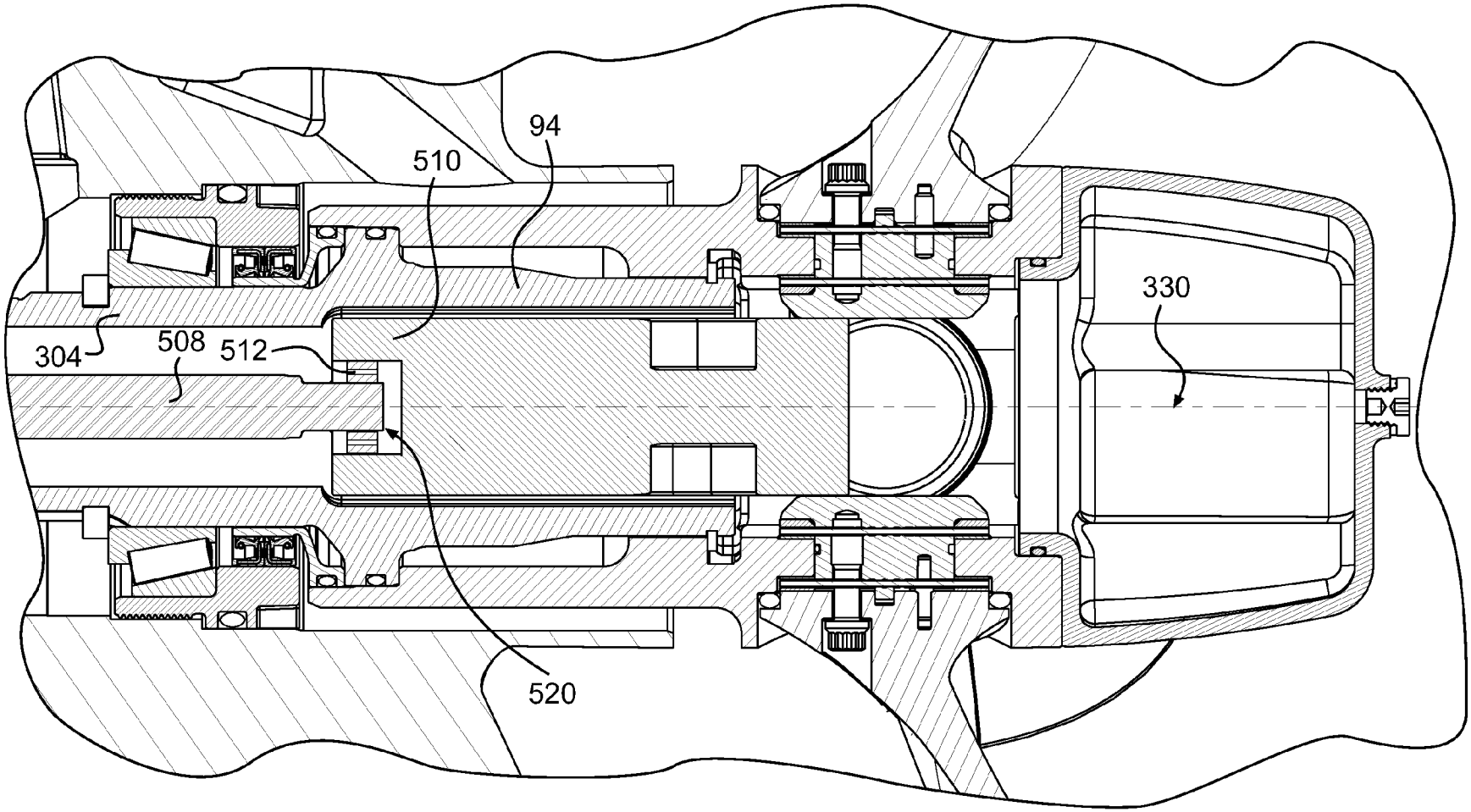
FIG. 11 is a close-up view of a cam region of an another alternative embodiment of variable pitch propeller system.

Another alternative way of rotatably connecting an actuator shaft, namely actuator shaft 508, and a cam, namely cam 510, is shown in FIG. 11. For simplicity and ease of understanding, parts of this alternative embodiment that are similar to those shown in FIGS. 1 to 8 and that function similarly to those described in those figures are referenced by the same reference numbers and will not be described again in detail.

The actuator shaft 508 extends through an aperture 520 in a forward end 516 of the cam 510. The aperture 520 does not extend though the cam 510. The aperture 520 has a diameter which is larger than a diameter of a portion of the actuator shaft 508 disposed in the aperture 520, thus allowing the actuator shaft 508 and the cam 510 to rotate freely with respect to each other.

A bearing 512 is press-fitted onto the actuator shaft 508 in the aperture 520, such that the bearing 512 is held between the actuator shaft 508 and an inner wall, defined by the aperture 520 of the cam 510. The bearing 512 provides a rotatable connection between the actuator shaft 508 and the cam 510. It is contemplated that the bearing 512 may be otherwise secured onto the actuator shaft 508. It is also contemplated that the actuator shaft 508 may extend only in part inside the cam 508.

A result of bearing 512 being held between the actuator shaft 508 and the inner wall defined by the aperture 520 in the cam 510, the actuator shaft 508 and the cam 510 are rotatably connected together, such that the actuator shaft 508 and the cam 510 are rotatable relative to each other, and such that the actuator shaft 508 and the cam 510 are able to reciprocate simultaneously along the actuator shaft axis 330 when the actuator shaft 508 is moved via the piston 306 similarly to the embodiments described above.

Figure 12:
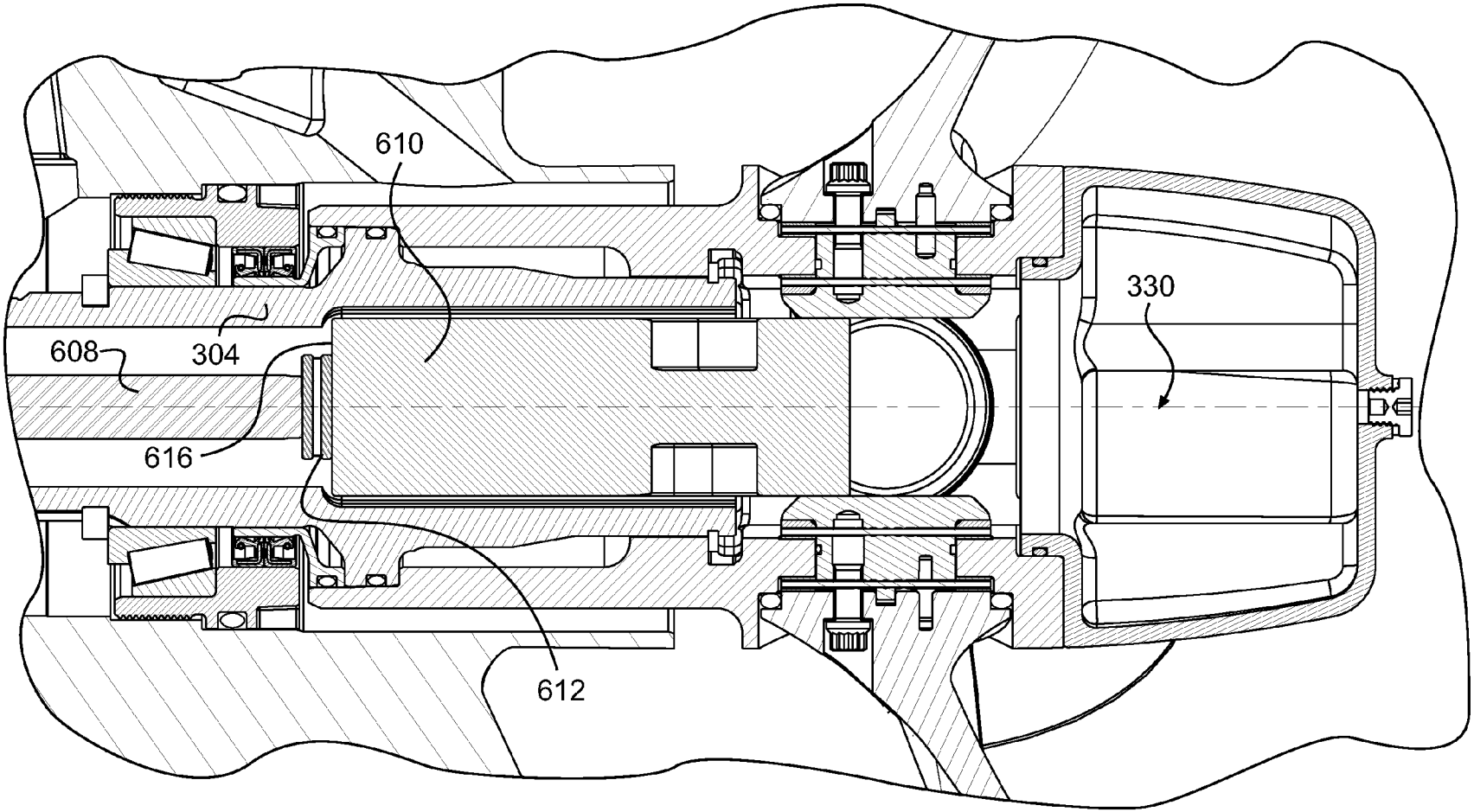
FIG. 12 is a close-up view of a cam region of a further alternative embodiment of variable pitch propeller system.

An alternative way of rotatably connecting an actuator shaft, namely actuator shaft 608, and a cam, namely cam 610, is shown in FIG. 12. For simplicity and ease of understanding, parts of this alternative embodiment that are similar to those shown in FIGS. 1 to 8 and that function similarly to those described in those figures are referenced by the same reference numbers and will not be described again in detail.

The actuator shaft 608 is fixed to a forward side of a bearing 612 and a forward end 616 of the cam 610 is fixed to a rearward side of the bearing 612, so as to rotatably connect the actuator shaft 608 and the cam 610 such that the actuator shaft 608 and the cam 610 are rotatable relative to each other and such that the actuator shaft 608 and the cam 610 are able to reciprocate simultaneously along the actuator shaft axis 330 when the actuator shaft 608 is moved via the piston 306 similarly to the embodiments described above.

Modifications and improvements to the above-described embodiments of the present invention may become apparent to those skilled in the art. The foregoing description is intended to be exemplary rather than limiting. The scope of the present invention is therefore intended to be limited solely by the scope of the appended claims.

What is claimed is:

1. A marine outboard engine, comprising:

a cowling;

an engine disposed in the cowling;

a driveshaft disposed generally vertically, the driveshaft having a first end and a second end, the first end of the driveshaft being operatively connected to the engine;

a gear case disposed generally below the engine;

a propeller shaft disposed at least in part in the gear case, the propeller shaft having a propeller shaft axis oriented generally perpendicularly to the driveshaft, the propeller shaft being operatively connected to the second end of the driveshaft;

an actuator disposed within the gear case, the actuator having a cam, the actuator being movable relative to the gear case between a first position, a second position and a third position, the second position being between the first position and the third position;

at least one recess formed in the cam, each of the at least one recess lying generally in a corresponding plane parallel to the propeller shaft axis, each of the at least one recess having a first segment, a second segment and a third segment, the second segment being between the first segment and the third segment, the first segment being oriented at a first angle relative to the propeller shaft axis;

the second segment being oriented at a second angle relative to the propeller shaft axis, the second angle being greater than the first angle; and the third segment being oriented at a third angle relative to the propeller shaft axis, the third angle being smaller than the second angle;

a propeller hub mounted to the propeller shaft; and at least one propeller blade pivotably mounted on the propeller hub, the at least one propeller blade being pivotable with respect to the propeller hub about a corresponding pivot axis, each pivot axis being oriented generally perpendicularly to the propeller shaft axis;

at least one cam follower disposed on a corresponding one of the at least one propeller blade and being adapted to engage a corresponding one of the at least one recess, the at least one cam follower engaging the first segment of its corresponding one of the at least one recess when the actuator moves between the first and second positions to vary a pitch of the at least one propeller blade between a first pitch and a second pitch, and the at least one cam follower engaging the second segment of its corresponding one of the at least one recess when the actuator moves between the second and third positions to vary the pitch of the at least one propeller blade between the second pitch and a third pitch.

2. The marine outboard engine of claim 1, wherein when the at least one cam follower engages the first segment of its corresponding one of the at least one recess, the pitch of the at least one propeller blade is such that operation of the marine outboard engine propels a watercraft in a forward direction when the propeller shaft is driven in a first direction.

3. The marine outboard engine of claim 2, wherein when the at least one cam follower engages at least a portion of the second segment of its corresponding one of the at least one recess, the pitch of the at least one propeller blade is such that operation of the marine outboard engine propels the watercraft in a reverse direction when the propeller shaft is driven in the first direction.

4. The marine outboard engine of claim 1, wherein:

the at least one recess includes three recesses;

the at least one propeller blade includes three propeller blades; and the at least one cam follower includes three cam followers.

5. The marine outboard engine of claim 1, wherein:

the at least one recess includes four recesses;

the at least one propeller blade includes four propeller blades; and the at least one cam follower includes four cam followers.

6. The marine outboard engine of claim 1, wherein:

the first segment of each recess is disposed forwardly of the second segment of their respective recess.

7. The marine outboard engine of claim 1, wherein the actuator is disposed at least in part inside the propeller shaft.

8. The marine outboard engine of claim 1, wherein:

the pitch of the at least one propeller blade varies between the first pitch and the second pitch at a first rate relative to a rate of movement of the actuator; and the pitch of the at least one propeller blade varies between the second pitch and the third pitch at a second rate relative to a rate of movement of the actuator;

the second rate being greater than the first rate.

9. The marine outboard engine of claim 8, wherein the second rate is at least 5 times the first rate.

10. The marine outboard engine of claim 8, wherein the first rate is less than 1.0 degrees per 1 mm of movement of the actuator.

11. The marine outboard engine of claim 10, wherein the first rate is approximately 0.3 degrees per 1 mm of movement of the actuator.

12. The marine outboard engine of claim 8, wherein the second rate is greater than 1.0 degrees per 1 mm of movement of the actuator.

13. The marine outboard engine of claim 12, wherein the second rate is approximately 3 degrees per 1 mm of movement of the actuator.

14. The propeller assembly of claim 13, wherein:

the first segment of each recess is disposed forwardly of the second segment of the respective recess.

15. The propeller assembly of claim 13, wherein:

the pitch of the first and second propeller blades varies between the first pitch and the second pitch at a first rate relative to a rate of movement of the cam; and the pitch of the first and second propeller blades varies between the second pitch and the third pitch at a second rate relative to a rate of movement of the cam;

the second rate being greater than the first rate.

16. The propeller assembly of claim 15, wherein the second rate is at least 5 times the first rate.

17. The marine outboard engine of claim 15, wherein the first rate is less than 1.0 degrees per 1 mm of movement of the cam.

18. The propeller assembly of claim 17, wherein the first rate is approximately 0.3 degrees per 1 mm of movement of the cam.

19. The marine outboard engine of claim 15, wherein the second rate is greater than 1.0 degrees per 1 mm of movement of the cam.

20. The propeller assembly of claim 19, wherein the second rate is approximately 3 degrees per 1 mm of movement of the cam.

21. A propeller assembly, comprising:

a propeller hub, at least one propeller blade pivotably mounted on the propeller hub, the at least one propeller blade being pivotable with respect to the propeller hub about a corresponding pivot axis, each pivot axis being oriented generally perpendicularly to a central axis of the propeller hub;

at least one cam follower disposed on a corresponding one of the at least one propeller blade;

a cam disposed at least in part inside the propeller hub, the cam being movable relative to the propeller hub along the central axis between a first position, a second position and a third position, the second position being between the first position and the third position;

at least one recess formed in the cam, the at least one recess being adapted to receive a corresponding one of the at least one cam follower, each of the at least one recess lying generally in a corresponding plane parallel to the central axis, each of the at least one recess having a first segment, a second segment and a third segment, the second segment being between the first segment and the third segment, the first segment being oriented at a first angle relative to the central axis;

the second segment being oriented at a second angle relative to the central axis, the second angle being greater than the first angle; and the third segment being oriented at a third angle relative to the central axis, the third angle being smaller than the second angle;

the at least one can follower engaging the first segment of its corresponding one of the at least one recess when the cam moves between the first and second positions to vary a pitch of the at least one propeller blade between a first pitch and a second pitch, and the at least one cam follower engaging the second segment of its corresponding one of the at least one recess when the cam moves between the second and third positions to vary the pitch of the at last one propeller blade between the second pitch and a third pitch.

22. The propeller assembly of claim 21, wherein when the at least one cam follower engages the first segment of the respective one of the at least one recess, the pitch of the at least one propeller blade is such that rotation of the propeller assembly in a first direction provides thrust in a first thrust direction.

23. The propeller assembly of claim 22, wherein when the at least one cam follower engages at least a portion of the second segment of the respective recesses, the pitch of the at least one propeller blade is such that rotation of the propeller assembly in a first direction provides thrust in a second thrust direction opposite to the first thrust direction.

24. The propeller assembly of claim 21, wherein:

the at least one recess includes three recesses;

the at least one propeller blade includes three propeller blades; and the at least one cam follower includes three cam followers.

25. The propeller assembly of claim 21, wherein:

the at least one recess includes four recesses;

the at least one propeller blade includes four propeller blades; and the at least one cam follower includes four cam followers.

* * * * *